US009121238B2

(12) United States Patent
Ellison

(10) Patent No.: US 9,121,238 B2
(45) Date of Patent: Sep. 1, 2015

(54) SUBSEA RUNNING TOOL WITH EMERGENCY RELEASE

(75) Inventor: Stuart James Ellison, Aberdeen (GB)

(73) Assignee: AKER SUBSEA LIMITED, Berkshire (GB)

( * ) Notice: Subject to any disclaimer, the term of this patent is extended or adjusted under 35 U.S.C. 154(b) by 184 days.

(21) Appl. No.: 13/817,607

(22) PCT Filed: Aug. 22, 2011

(86) PCT No.: PCT/GB2011/001252

§ 371 (c)(1),
(2), (4) Date: Feb. 19, 2013

(87) PCT Pub. No.: WO2012/025714

PCT Pub. Date: Mar. 1, 2012

(65) Prior Publication Data

US 2013/0146298 A1 Jun. 13, 2013

(30) Foreign Application Priority Data

Aug. 23, 2010 (GB) ..... 1014088.7

(51) Int. Cl.
*E21B 23/00* (2006.01)
*E21B 23/04* (2006.01)
*E21B 33/038* (2006.01)

(52) U.S. Cl.
CPC ..... *E21B 23/00* (2013.01); *E21B 23/04* (2013.01); *E21B 33/038* (2013.01)

(58) Field of Classification Search
CPC ..... E21B 23/00; E21B 23/04; E21B 33/038
USPC ..... 166/345, 348, 351, 360.361, 365, 382
See application file for complete search history.

(56) References Cited

U.S. PATENT DOCUMENTS 3,087,547 A * 4/1963 Raulins et al. ..... 166/89.1
4,161,984 A 7/1979 Watkins
4,479,539 A * 10/1984 Tamplen et al. ..... 166/212
4,510,995 A 4/1985 Krause, Jr. et al.

(Continued)

FOREIGN PATENT DOCUMENTS

CN 200952369 Y 9/2007
CN 101806199 A 8/2010

OTHER PUBLICATIONS

International Search Report for PCT/GB2011/001252 mailed Jan. 4, 2013.

(Continued)

*Primary Examiner* — James G Sayre
(74) *Attorney, Agent, or Firm* — Nixon & Vanderhye P.C.

(57) ABSTRACT

A running tool for use in the insertion of an object such as a casing hanger into a subsea well includes a body and a hollow mandrel moveable within the body. Engagement dogs are supported within the body and are moveable to engage the object, the mandrel having a first part and a transition part, the transition part being shaped to cause out-ward movement of the dogs when the mandrel is in a given position within the body and to allow movement of the dogs for position of the mandrel spaced form the given position. The tool has an emergency release feature wherein the transition part is releasably attached to the first part by shear pins which shear in response to a sufficient increase in pressure within the mandrel to allow the transition part to separate from the first part.

10 Claims, 4 Drawing Sheets

(56) References Cited

U.S. PATENT DOCUMENTS

| | | | | |
|---|---|---|---|---|
| 5,375,662 | A * | 12/1994 | Echols et al. | 166/386 |
| 5,542,475 | A | 8/1996 | Turner et al. | |
| 6,062,312 | A | 5/2000 | Wilkins | |
| 6,241,023 | B1 * | 6/2001 | Krauss et al. | 166/387 |
| 2009/0200040 | A1 | 8/2009 | Smith, Jr. et al. | |
| 2010/0126776 | A1 | 5/2010 | Trevino et al. | |

OTHER PUBLICATIONS

Written Opinion of the International Searching Authority mailed Jan. 4, 2013.

Office Action dated Dec. 1, 2014 in CN 201180040607.7 with English translation.

Search Report dated Nov. 1, 2010 in GB 1014088.7.

* cited by examiner

SUBSEA RUNNING TOOL WITH EMERGENCY RELEASE

This application is the U.S. national phase of International Application No. PCT/GB2011/001252 filed 22 Aug. 2011 which designated the U.S. and claims priority to GB 1014088.7 filed 23 Aug. 2010, the entire contents of each of which are hereby incorporated by reference.

TECHNICAL FIELD

This invention relates to running tools of the kind employed for the insertion of components such as casing strings or pipes into a subsea well.

BACKGROUND

During subsea completion operations it is very difficult, and often practically impossible, to recover a casing string or pipe once it has been run into a well, owing to frictional and suction effects acting on the outer wall of the casing string or pipe. Once the casing string or pipe has landed out in the wellhead, the rig or vessel from which the operation is performed is vulnerable, because it is potentially connected mechanically to an irretrievable object. This vulnerability is increased when the weather conditions or sea state begin to deteriorate. In such circumstances the rig or vessel would need to disconnect from the wellhead; otherwise substantial damage can be sustained by the hardware and the level of danger to which the crew onboard are exposed is greatly increased. In the event of the mechanical interface between the rig or vessel and the well malfunctioning or failing to operate, a secondary system of severance or retrieval would offer significant mitigation of the dangers mentioned above.

The example embodiments provide, in a preferred form a redundant emergency release mechanism which allows the rig or vessel to disconnect with the aid of several operational features which are typically available in an offshore completion operation, preferably including rotation of the drill pipe both clockwise and anti-clockwise and the application of a pressure either by the application of bore pressure or by using a self-sealing dart deployed from the drill floor.

The state of the art is exemplified by the document U.S. Pat. No. 6,062,312-A, which discloses a running tool which has a mechanical mechanism for unlatching the running tool from a side valve tree.

BRIEF SUMMARY

An example embodiment provides a running tool for use in the insertion of an object into a subsea wed, comprising a body, a hollow mandrel moveable within the body, a plurality of dogs which are supported within the body and moveable to engage the object, the mandrel having a first part and a transition part, the transition part being shaped to cause outward movement of the dogs when the mandrel is in a given position within the body and to allow movement of the dogs for positions of the mandrel spaced form the given position, wherein the transition part is releasably attached to the first part by means which respond to a sufficient pressure within the mandrel to allow the transition part to separate from the first part.

The means which respond may comprise a shearable member or assembly which has a shear strength selected so that it shears to allow release of the transition part from the first part in response to a predetermined pressure within the mandrel. Alternatively the means may comprise a split ring which in an expanded state locks the transition part to the first part but is arranged to be compressed radially, to allow release of the transition part from the part in response to a sufficient bore pressure.

The parts of the mandrel are preferably generally cylindrical and the means may connect an upper rim of the transition part to a lower rim of the said first part. The means comprise shear pins each of which is disposed in a radial bore extending through the lower rim and in a socket in the upper rim.

The example embodiment also provides a method of releasing a running tool which is employed for the insertion of an object into a subsea well, the running tool comprising a body, a hollow mandrel moveable within the body, a plurality of dogs which are supported within the body and moveable-to engage the object, the mandrel having a first part and a transition part, the transition part being shaped to cause outward movement of the dogs when the mandrel is in a given position within the body and to allow movement of the dogs for positions of the mandrel spaced from the given position, the method comprising applying pressure within the mandrel sufficient to cause the transition part to separate from the first part.

The way in which the emergency disconnect works is that a pressure can be applied at any time to release the releasable means which holds the said first part of the mandrel and the transition part of the mandrel together under normal operations. When a certain pressure is applied the mandrel's parts will separate, the first part being retained in position and the transition part accelerating into the nose of the tool. This renders the locking dogs free to collapse radially.

One example of the invention will be described with reference to the drawings.

DETAILED DESCRIPTION OF EXAMPLE EMBODIMENTS

Figure 1:
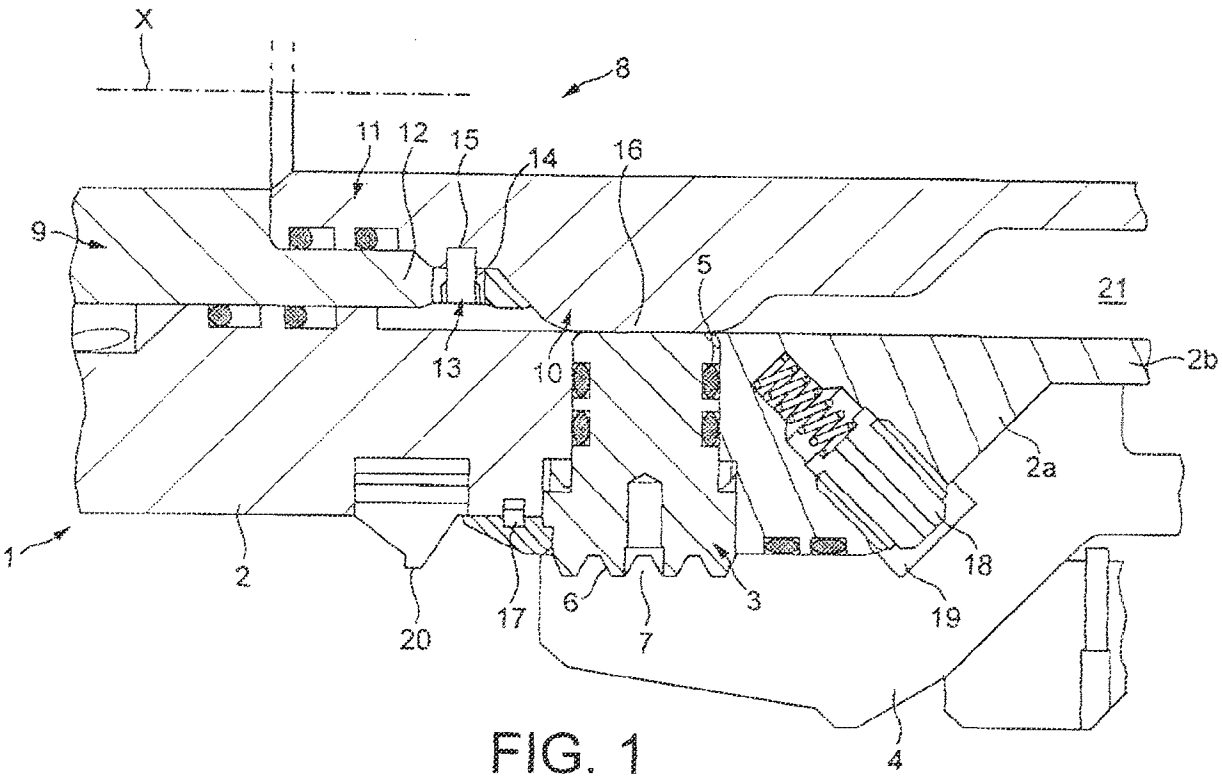
FIG. 1 illustrates in section the relevant part of a first embodiment of a running tool incorporating the invention.
Figure 2:
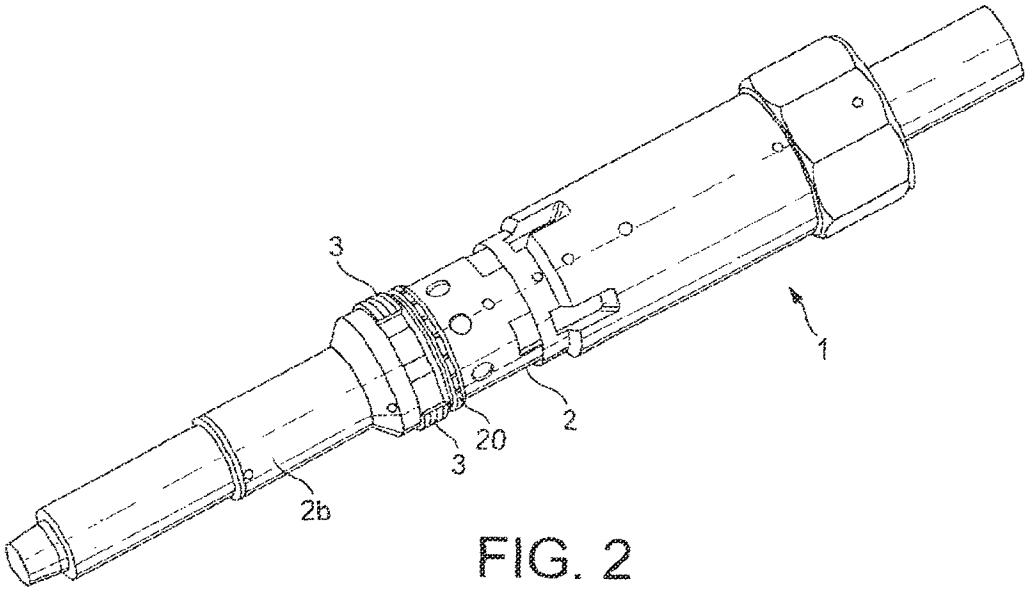
FIG. 2 is an isometric view of the running tool.

FIG. 1 shows in section the relevant part of a running tool 1 which is intended for the insertion of an object such as a casing hanger into the bore of a subsea wellhead. The tool has a generally cylindrical body 2 although only part of one side thereof is shown in FIG. 1, which is a half-section, the central axis of the running tool being indicated by the line X.

The tool 1 carries a plurality of radially moveable locking dogs of which only one locking dog 3 is shown in the Figure. This and the other locking dogs are adapted to engage and hold an object such as a casing hanger 4 until the casing hanger is securely landed in the body of the wellhead. For this purpose the locking dog 3 is mounted in a radial bore 5 through the wall of the body 2. It has an outer toothed profile 6 which engages a complementary profile 7 on the inside of the casing hanger 4.

Within the body 2 of the tool is a cylindrical mandrel 8 which is axially moveable within the bore of the body of the tool 1. In this example the mandrel 8 has a first, externally screw-threaded, part 9 which engages an internal screw-threading in the body of the tool 1. In practice the screw-threading may be disposed towards the top end of the tool, i.e. to the left of the parts shown in FIG. 1.

Attached to the part 9 is a transition part 10. In this example the transition part 10 has an upper rim 11 which fits within a lower rim 12 of the threaded part 9 and is attached to the threaded part 9 by means of a plurality of shear pins, circumferentially spaced around the mandrel. One of these pins is shown at 13. It fits within a radial bore 14 in the rim 12 of the first part 9 and a socket 15 in the rim 11 of the transition part 10.

The transition part has an outwardly extending ridge 16 which is of larger diameter than the remainder of the transition part 10 and the threaded part 9 of the mandrel. When the ridge 16 abuts the inner end of the dog 3 (e.g. in preparation for running the casing hanger) the dog is moved to its outermost position as shown in FIG. 1 and the casing hanger 4 is held by the running tool. The tolerance in the position of the mandrel 8 for outward movement of the dogs 3 depends on the axial extent of the ridge 16. For positions of the mandrel sufficiently spaced away from this position the ridge 16 is out of engagement with the inner ends of the dogs 3 which can then collapse inwards to release the casing hanger 4. The angles of the profile 6 are, in accordance with ordinary practice, such as to allow inward movement of the dogs in response to the (downward) force exerted by the object such as the casing hanger held by the dogs.

On the outside of the body 2 is a retaining ring 17 which limits outward movement of the dogs 3. Shown to the right of the dog 3 (and below it in a normal configuration of the tool) is a plunger 18 which can protrude into a slot 19 in the casing hanger 4 and thereby prevent rotation of the tool relative to the hanger 4. The outside of the body 2 also carries latches, such as the latch 20, which are used to locate the tool in the wellhead and require release when the tool is to be retrieved from the wellhead.

Beyond the plunger 18 the body 2 has an inward taper 2*a* to a cylindrical part 2*b* of lesser outside diameter.

In ordinary operation, when the casing hanger 4 has been landed, the mandrel is moved axially (e.g. by rotation) to release the transition part 10, and in particular the ridge 16, from the dog 3.

The separable relationship between the parts 9 and 10 of the mandrel provides an emergency release feature. In the described embodiment, the shear pins are selected to have a shear strength sufficient to withstand normal bore pressures that occur during for example the pumping of cement through the bore of the tool down into the well bore. The actually selected shear strength will depend on to the weight of the transition part and possibly other parts of tool that may have to be supported by the mandrel, as well as the normal bore pressures. However, by means of a sufficient increase in pressure on the transition part, applied either by a selected increase in the bore pressure (e.g. by the pumping of cement) or by means of a dart projected into the bore of the tool, the shear pins can be made to shear, releasing the transition part from the rest of the mandrel. There will be a difference in pressure between the bore and the void 21 between the transition part and the body of the tool. The release of the transition part allows the dogs to collapse radially, thereby releasing the tool from the casing hanger or other object to which it had been attached. The tool is thereby no longer fixed to a static object and the dangers noted above can be averted.

Figure 3:
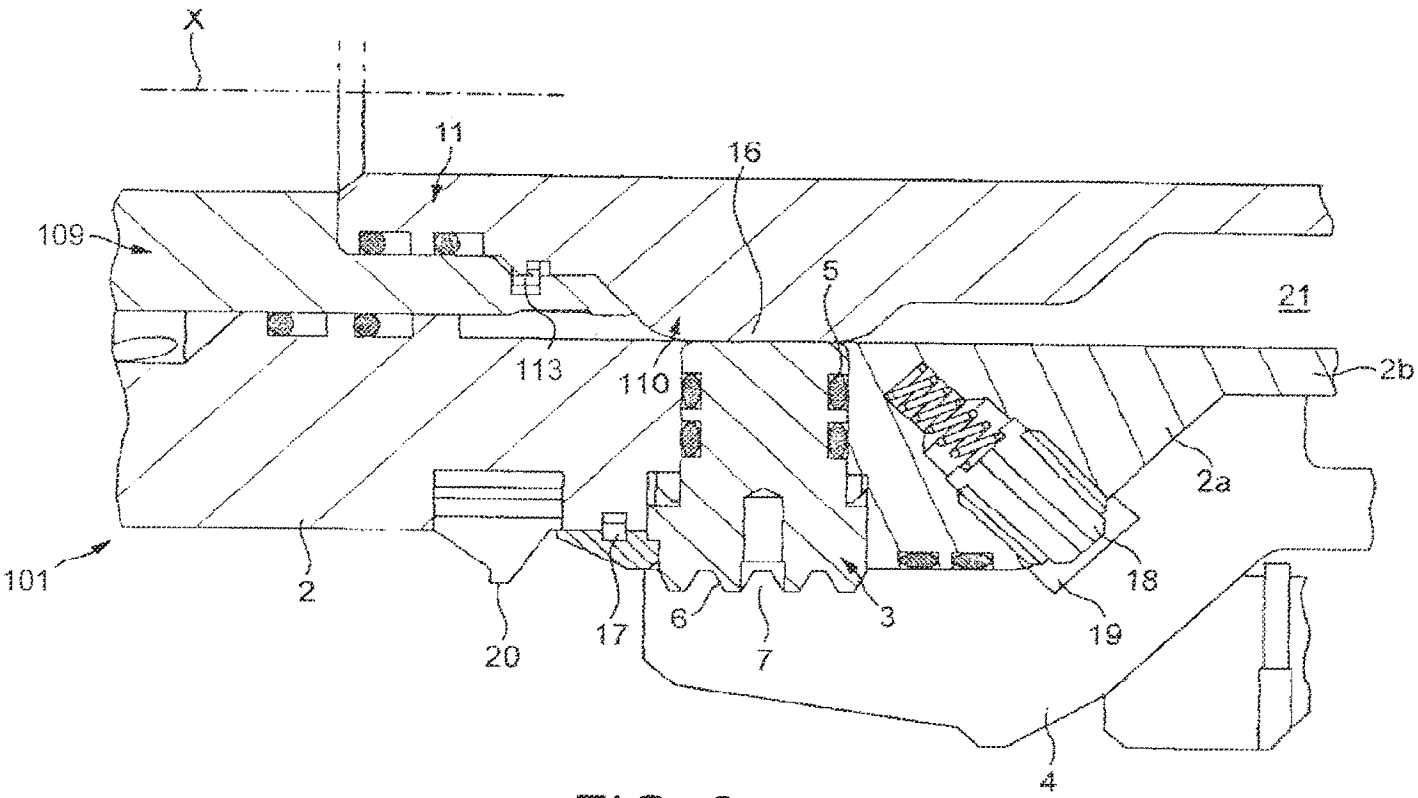
FIG. 3 illustrates in section the relevant part of a second embodiment of a running tool incorporating the invention.
Figure 4:
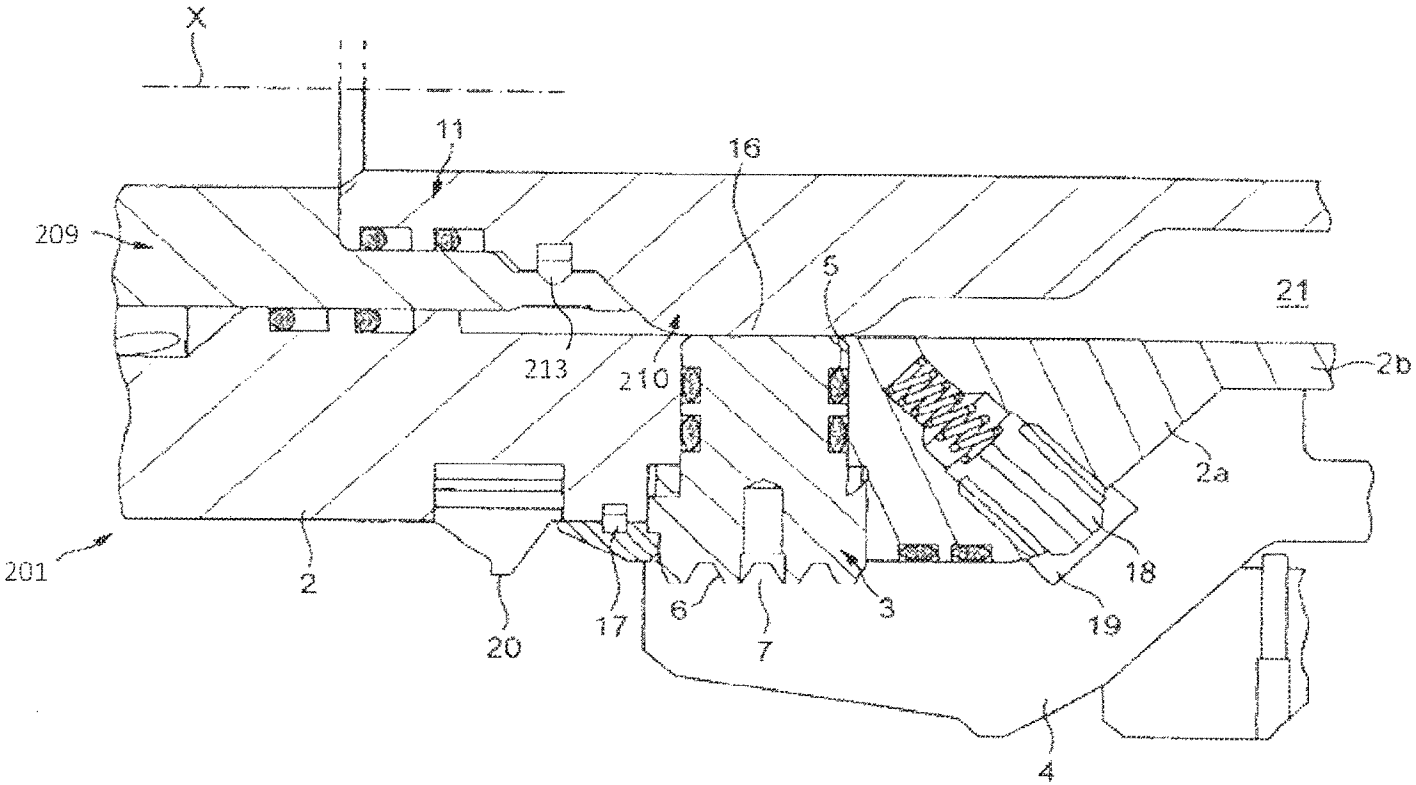
FIG. 4 illustrates in section the relevant part of a third embodiment of a running tool incorporating the invention.

FIG. 3 shows an alternative to the shear pins 13 in the form of a shear ring 113 which, like the shear pins 13, would shear to release the transition part 110 from the first part 109 of the tool 101 in response to a sufficient axially directed pressure. A further option, shown in FIG. 4, is a split ring 213 which in an expanded state (shown in FIG. 4) locks the transition part 210 to the first part 209 of the tool 201 but is arranged to be compressed radially, to allow release of the part 10 from the first part 209 in response to a sufficient bore pressure.

What is claimed is:

1. A running tool for use in the insertion of an object into a subsea well, comprising a body, a hollow mandrel moveable within the body, a plurality of dogs which are supported within the body and moveable to engage the object, the mandrel having a first part and a transition part, the transition part being shaped to cause outward movement of the dogs when the mandrel is in a given position within the body and to allow movement of the dogs for positions of the mandrel spaced from the given position, wherein the transition part is releasably attached to the first part by one or more elements which respond to a sufficient pressure within the mandrel to allow the transition part to separate from the first part.

2. A tool according to claim 1 in which the said one or more elements comprise a shearable member which has a shear strength selected so that it shears to allow release of the transition part from the first part in response to a predetermined pressure within the mandrel.

3. A tool according to claim 1 in which the said one or more elements comprise a split ring which in an expanded state locks the transition part to the first part but is arranged to be compressed radially, to allow release of the transition part from the part in response to a sufficient bore pressure.

4. A tool according to claim 1, in which the said parts of the mandrel are generally cylindrical and the said one or more elements connect an upper rim of the transition part to a lower rim of the said first part.

5. A tool according to claim 4 in which the said one or more elements comprise shear pins each of which is disposed in a radial bore extending through the said lower rim and in a socket in the said upper rim.

6. A tool according to claim 1, in which the dogs are disposed in radial bores in the body of the tool so as to protrude laterally from the body.

7. A tool according to claim 6, in which the transition part has an external ridge for engagement with an inner end of each dog.

8. A tool according to claim 1, in which the said first part makes a threaded engagement with the inside of the body of the tool.

9. A method of releasing a running tool which is employed for the insertion of an object into a subsea well, the running tool comprising a body, a hollow mandrel moveable within the body, a plurality of dogs which are supported within the body and moveable to engage the object, the mandrel having a first part and a transition part, the transition part being shaped to cause outward movement of the dogs when the mandrel is in a given position within the body and to allow movement of the dogs for positions of the mandrel spaced from the given position, the method comprising applying pressure within the mandrel sufficient to cause the transition part to separate from the first part.

10. A method according to claim 9 in which the first part and the transition part are releasably attached together by means of a shear ring or a plurality of shear pins, the applied pressure being sufficient to shear the ring or pins.

* * * * *